US005655174A

United States Patent [19]

Hirst

[11] Patent Number: 5,655,174

[45] Date of Patent: Aug. 5, 1997

[54] SYSTEM WITH AMBIENT SENSOR FOR ESTIMATING PRINTING SUPPLY CONSUMPTION

[75] Inventor: Mark Hirst, Boise, Id.

[73] Assignee: Hewlett-Packard Company, Palo Alto, Calif.

[21] Appl. No.: 651,309

[22] Filed: May 22, 1996

[51] Int. Cl.[6] ..... G03G 15/06

[52] U.S. Cl. ..... 399/27; 347/19; 399/44; 399/260

[58] Field of Search ..... 399/27, 28, 29, 399/44, 224, 260; 347/19

[56] References Cited

U.S. PATENT DOCUMENTS

| | | | |
|---|---|---|---|
| 4,847,641 | 7/1989 | Tung | 346/154 |
| 5,252,995 | 10/1993 | Trask et al. | 346/157 |
| 5,305,199 | 4/1994 | LoBiondo et al. | 364/403 |
| 5,327,196 | 7/1994 | Kato et al. . | |
| 5,349,377 | 9/1994 | Gilliland et al. | 346/153.1 |
| 5,436,705 | 7/1995 | Raj | 355/246 |
| 5,491,540 | 2/1996 | Hirst | 355/200 |

*Primary Examiner*—R. L. Moses

[57] ABSTRACT

A system of the present invention includes an ambient condition sensor for estimating the consumption of toner, developer, or similar printing supply in an electrostatic or ink jet printer. In a preferred embodiment, the ambient condition being monitored is relative humidity, though in other embodiments other indicators of ambient air conductivity or break down voltage are measured. Consumption is estimated by classifying each pixel to be printed according to the number of neighbors of that pixel, accumulating a sum according to each classification, multiplying each accumulated sum by a weight that accounts for its classification, and calculating an overall sum of the weighted products. The overall sum is then scaled by a factor that accounts for the conductivity of ambient air as measured by the sensor to provide an incremental estimate of consumption. The scaling factor is determined by empirical studies. A warning such as "low toner" is displayed on the printing device and on a remote console when the integrated incremental estimates of consumption surpass a limit.

20 Claims, 3 Drawing Sheets

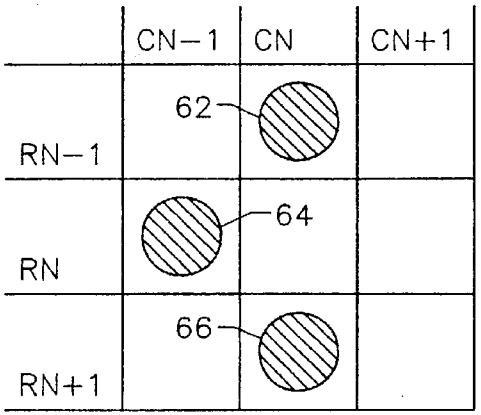
Fig. 2
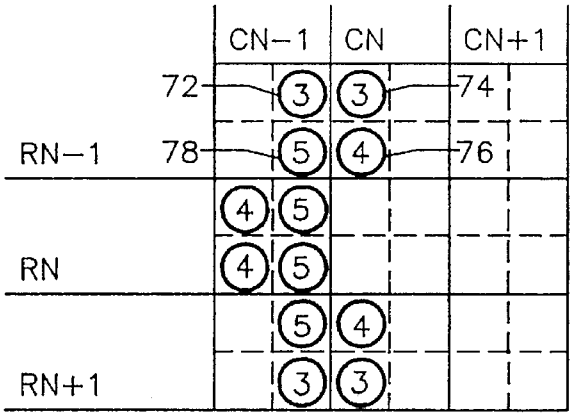
Fig. 3
| NUMBER OF NEIGHBORS | ACCUMULATED COUNT THIS PAGE | WEIGHT | ESTIMATED TONER USE |
|---|---|---|---|
| 0 | 0 | W1 | 0 |
| 1 | 0 | W2 | 0 |
| 2 | 0 | W2 | 0 |
| 3 | 4 | W3 | 12 |
| 4 | 4 | W4 | 16 |
| 5 | 4 | W3 | 12 |
| 6 | 0 | W2 | 0 |
| 7 | 0 | W2 | 0 |
| 8 | 0 | W1 | 0 |
| PAGE TOTAL | | | 40 |
Fig. 4
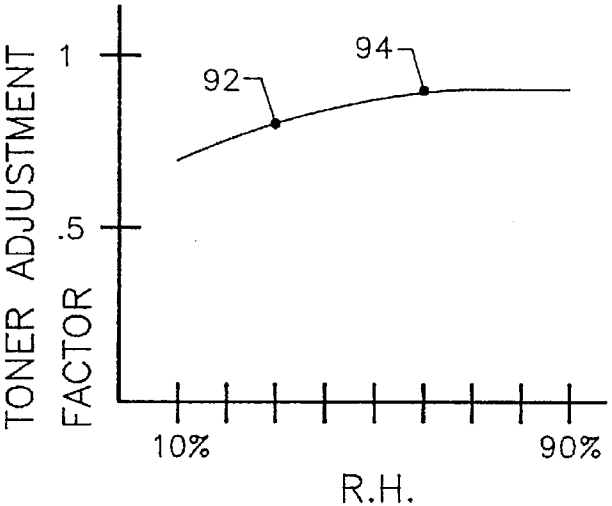
Fig. 5

SYSTEM WITH AMBIENT SENSOR FOR ESTIMATING PRINTING SUPPLY CONSUMPTION

FIELD OF THE INVENTION

Embodiments of the present invention relate to printing apparatus and to systems for sensing consumption of a printing supply.

BACKGROUND OF THE INVENTION

As an introduction to the problems solved by the present invention, consider conventional electrostatographic printing apparatus such as that used in printers, facsimile machines, and copiers, to name a few common applications. In such applications, operations can include unattended operation for long periods of time and large batch operations involving many printed pages between occasions when an operator can examine the print quality.

A lack of a consumable printing supply such as toner can result in the onset of unacceptable print quality with consequential waste of resources while unacceptable quality printing continues. Manual intervention is often required to renew the supply and, if possible, restart the batch operation. In the case of facsimile machines and network printers, further consequential costs accrue for an interruption of business in order to notify the appropriate users who are able to restart particular transmissions and automated operations.

Toner for an electrostatographic printing apparatus is conventionally packaged either in a replaceable cartridge having additional precision mechanical and electronic assemblies, or in bulk for use with a hopper receptacle in the apparatus. Replenishment of toner in most cases is an operation requiring some personal and equipment safety training and some familiarity with the internals of the apparatus. In the case of bulk toner, the operator must understand correct methods of handling the toner material itseft. If a lack of sufficient toner is first noticed during a batch operation, trained operators may not be immediately available to properly suspend wasteful printing or replenish the supply. If, on the other hand, a fresh toner cartridge is added prior to beginning a batch operation, unused toner in the removed cartridge is usually discarded.

Waste of organizational resources and of printing supplies adds to the actual per page cost of printing and has a detrimental impact on the timeliness and quality of business communications in general.

In view of the problems described above and related problems that consequently become apparent to those skilled in the applicable arts, the need remains in printing apparatus for improved systems for sensing consumption of a printing supply.

SUMMARY OF THE INVENTION

Accordingly, a system in one embodiment of the present invention includes an ambient condition sensor, a memory, and a processor. The memory stores a pixel description while the processor provides a signal in response to estimating incremental consumption of a printing supply in response to the sensor and to the pixel description.

According to a first aspect of such an embodiment, an accurate estimate of consumption results from accounting for variations in an ambient condition that affects consumption. When estimates are accurate, automatic suspension of printing can be more efficiently used to avoid wasteful low quality printing and to direct further printing to equipment having sufficient supplies. Unnecessary attention to supplies can also be avoided.

In another embodiment of the present invention, a printer includes first means for determining data that describes a plurality of pixels to be printed, a humidity sensor, and second means for determining a low toner condition. The sensor provides a sensor signal. The second means includes a circuit that estimates toner consumption in response to the data from the first means and to the sensor signal.

According to a first aspect of such an embodiment, relative humidity is a proxy for air conductivity. Air conductivity has been found to be inversely proportional to toner consumption. By accounting for changes in relative humidity, accurate estimates of toner consumption are made possible.

The present invention is practiced according to a method for sensing consumption of a printing supply in one embodiment which includes the steps of: receiving a first signal proportional to an ambient condition; receiving a second signal that describes a plurality of pixels to be printed; and providing a third signal in response to an estimate of consumption of the printing supply. The estimate is responsive to the first signal and to the second signal.

According to a first aspect of such a method, either analog, digital, or a combination of analog and digital circuit and software techniques are used to practice such a method. The resulting design flexibility permits the method to be practiced in a wide variety of systems, among which cost-benefit and market pricing factors vary significantly.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

BRIEF DESCRIPTION OF THE DRAWINGS

FIG. 2 is a layout of pixels to be printed on the system of Figure.

FIG. 3 is a layout of subpixels to be printed based on the pixel layout of Figure.

FIG. 4 is a chart of accumulated subpixel counts based on the subpixel layout of Figure.

FIG. 5 is a graph of toner use adjustment values versus values of relative humidity for calculating toner consumption in the system of Figure.

In each functional block diagram, a broad arrow symbolically represents a group of signals that together signify a binary code. For example, a group of address lines is represented by a broad arrow because a binary address is signified by the signals taken together at an instant in time. A group of signals having no binary coded relationship is shown as a single line with an arrow. A single line between functional blocks represents one or more signals.

DETAILED DESCRIPTION OF THE PREFERRED EMBODIMENT

Figure 1:
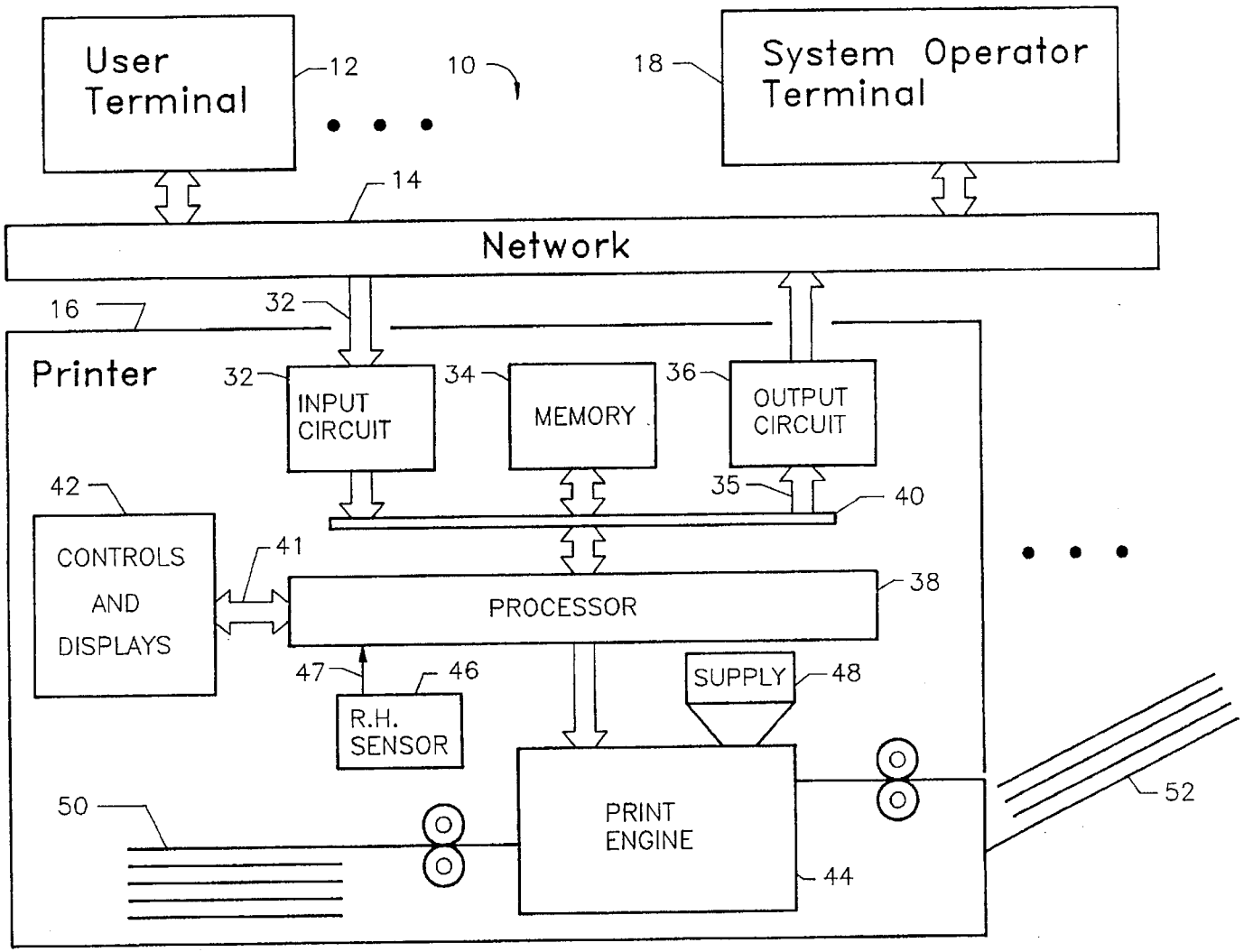
FIG. 1 is a block diagram of a system of the present invention.

FIG. 1 is a block diagram of a system of the present invention. System 10 includes one or more user terminals 12 that pass print commands and print data on network 14 to one or more printers 16. One printer 16, as shown, monitors toner consumed in the printing process and reports a low-toner condition to one user terminal 12, as shown, and system operator terminal 18 via print status messages on network 14. User terminal 12 and system operator terminal 18 are conventional workstations with internal computing capability. Network 14 is a conventional network that facilitates data exchange among several system components not shown including various types of terminals, printers, file servers, computers, communication devices, and input/output devices.

Printer 16 includes input circuit 32, memory 34, and output circuit 36 all joined for communication with processor 38 via bus 40. These components cooperate as means for determining data that describes a plurality of pixels to be printed. In addition, printer 16 includes controls and displays 42, print engine 44, and relative humidity sensor 46. Supply 48 is mounted to print engine 44 for the delivery of a consumable printing supply. In the embodiment shown, supply 48 supplies powdered monochrome toner. These components generally are designed, assembled, programmed, and configured to cooperate according to design and manufacturing materials and methods well known in the electrostatographic printer arts.

In operation, print data from network 14 is received by input circuit 32, passed to processor 38, and stored for analysis in memory 34. The print data is analyzed by the processor and enhanced by conventional techniques including, the following U.S. patents and applications. Resolution enhancement technology is of the type described in U.S. Pat. No. 4,847,641 by Tung. Edge recognition technology is of the type described in U.S. Pat. No. 5,252,995 by Trask et al., patent application Docket No. 10960262-1, "Adjustment of Dot Size for Laser Images", by Trask et al., patent application Docket No. 10960235-1, "Software-Based Procedure for Conversion of a Scalable Font Character Bitmap to a Gray Level Bitmap", by Smith et al, and patent application Docket No. 10960234-1, "Software-Based Procedure and Apparatus for Enhancement of a Gray Level Image", by Smith et al. Pixel counting and weighting methods are of the type described in U.S. Pat. No. 5,349,377 to Gilliland, et al. In addition, the print data is analyzed according to methods to be discussed with reference to FIG. 6.

Print data in an internal format is then passed to print engine 44 where a latent image is formed. After one page is dispensed from stack 50 into print engine 44, the latent image is formed onto the page and then developed. In the process of being developed, toner from supply 48 is dispensed and fixed onto the page and unused toner is recovered for future use. The printed page is finally routed from print engine 44 to output tray 52. The embodiment shown uses conventional media, apparatus, and methods for the formation of the latent image, page routing, image development, toner dispensing, fixing, and recovery. The net consumption of toner however is monitored and controlled by methods of the present invention.

Accurate estimates of toner consumption are responsive to subpixel classifications to be described by an example discussed below with reference to FIGS. 2 and 3. Printer 16 forms text and graphic images from pixels and subpixels. A pixel, or picture element, is the smallest unit of print data described by user terminal 12 and communicated to printer 16 via network 14. Resolution enhancement, edge recognition, and other conventional technologies analyze print data on the basis of subpixels for higher print quality.

FIG. 2 is a layout of pixels 62, 64, and 66 to be printed on the system of FIG. 1. The layout is a form of monochromatic pixel description and corresponds roughly to a portion of the digit "3" near the midpoint of the character. The three rows and three columns of the layout are identified with reference to row $R_N$ and column $C_N$ corresponding to a region to be printed. Such a region includes a narrow swathe of about 20 rows extending across the page to be printed along an axis orthogonal to the path of the page through print engine 44.

FIG. 3 is a layout of subpixels to be printed. The layout is a form of subpixel description developed from the pixel layout of FIG. 2. Subpixels are defined by a grid, shown in dotted lines, that subdivides each row and column. Consequently the nine pixel locations identified by the intersection of three rows and three columns in FIG. 2 correspond to 36 subpixel locations in FIG. 3. In this example, 12 subpixels were selected by processor 38 to represent pixels 62, 64, and 66 so that the overall image would have higher print quality. Each printing subpixel is further classified by an integer, as shown, representing the number of immediately adjacent printing subpixels.

FIG. 4 is a chart of accumulated subpixel counts based on the subpixel layout of FIG. 3. Subpixel counts are accumulated in column 2 according to a classification. The classification in column 1 is based on the number of neighbors indicated by an integer in each printing subpixel shown in FIG. 3. Counts are accumulated for an entire page, though FIG. 4 presents totals for only one portion of one region for clarity of presentation. Each accumulated count is multiplied by a weight in column 3 to produce a weighted product in column 4. Weighted products are summed for the page total.

Subpixels having a larger number of neighbors are located within a solid area of the region. Subpixels having a smaller number of neighbors are located near an edge in the region. Since toner consumption is known to be greater near an edge than within a solid area, weighted products by classification participate in the calculation of estimated toner consumption.

FIG. 5 is a graph of toner use adjustment values versus values of relative humidity for calculating toner consumption in the system of FIG. 1. Data points for the graph are stored in memory 34 as a look-up table of supply consumption factors versus humidity measurements. Data points for a particular printer 16 are predetermined by conventional empirical study. The data points shown in FIG. 5 are provided for simplicity of explanation. Linear, piece-wise linear, algorithmic, nonlinear, algebraic, and combinations of such data may result from empirical studies. In conducting a study, care must be taken to account for factors that may degrade the accuracy of the study's conclusions. Humidity data is strongly dependent on the hygroscopic properties of the toner, the developing process, and the materials used to manufacture printer 16. In addition, data points will be dependent on the position of humidity sensor 46 within printer 16 relative to supply 48, direct and indirect air conditioning affects of components within printer 16, possible obstruction of air flow, the extent of air ionization, particulate content, and other factors that will become apparent on practice of the invention in a particular printing apparatus.

In operation, processor 44 determines a relative humidity value by receiving a signal from relative humidity sensor 46 and processing the signal for normalization, noise rejection, and calibration purposes. A toner use adjustment factor between 0 and 1 is read from memory corresponding to the relative humidity value. In the illustrated embodiment, toner consumption is estimated incrementally by multiplying a page total of weighted products from FIG. 4 with a toner use adjustment factor from FIG. 5. Processor 38 uses the resulting incremental estimate to indicate a "low toner" condition on controls and displays 42 and to generate various reports communicated via the network by output circuit 36. Output circuit 36 cooperates with processor 38, memory 34, and network 14 as means for providing a report at a location remote from the printer.

Figure 6:
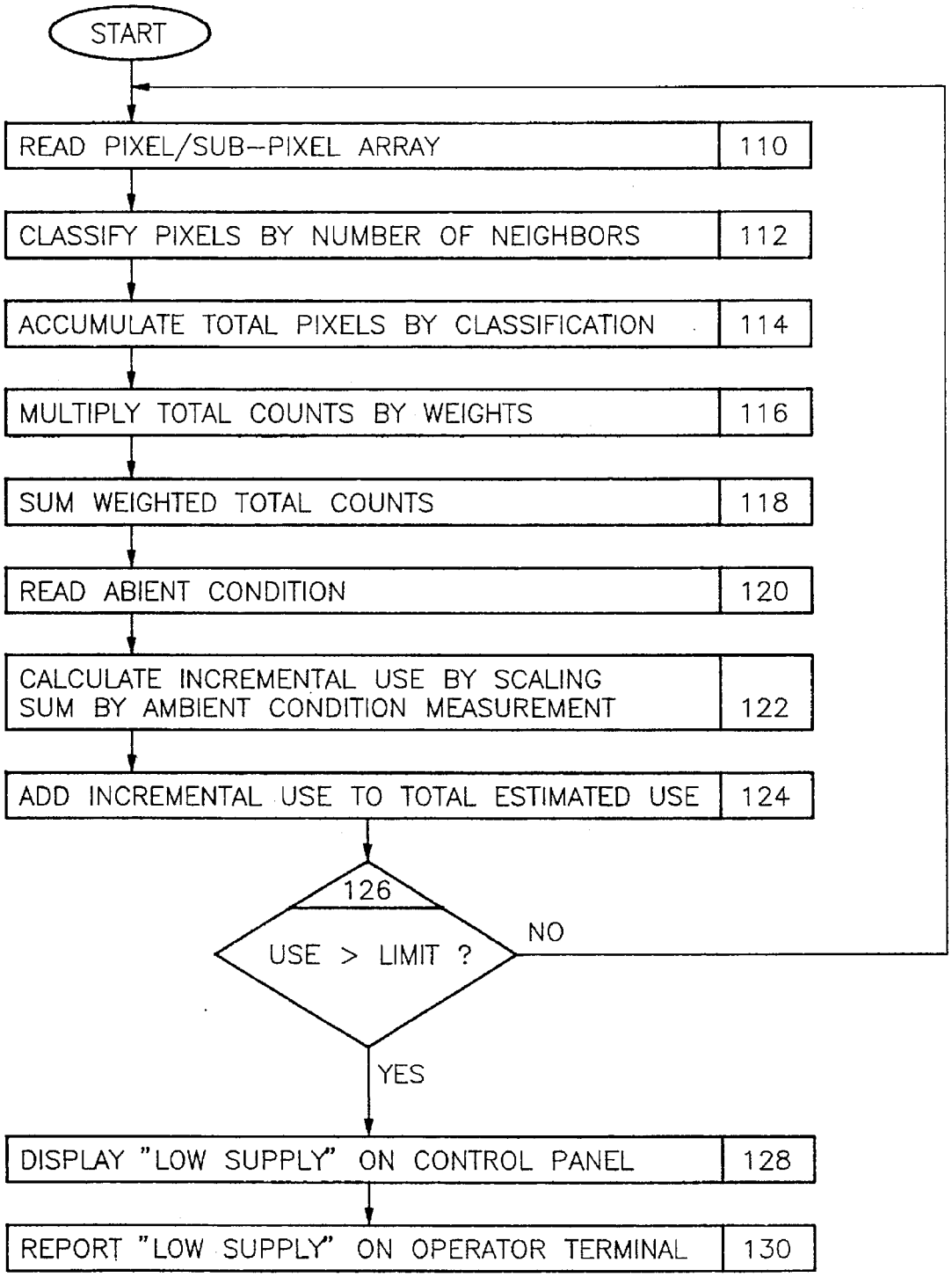
FIG. 6 is a flow chart of a method of the present invention.

FIG. 6 is a flow chart of a method of the present invention. For the illustrated embodiment, the method shown is performed by cooperation of hardware, firmware, and software to be discussed below. Prior to step 110, print data is received by processor 38, arranged in an array in memory 34, and analyzed for proper subpixel representation. Steps 110 and 112 correspond to the discussion of FIG. 3. Steps 114, 116, and 118 correspond to the discussion of FIG. 4. Steps 120 and 122 correspond to the discussion of FIG. 5 wherein processor 38 receives a signal proportional to an ambient condition.

At step 124, the incremental toner consumption estimate given by the product of the toner use adjustment factor from FIG. 5 with the page total from FIG. 4 is accumulated over many consecutively printed pages as a total estimated use. The total estimated use is available for further processing, an example of which is shown in steps 126 through 130.

At step 126, the total estimated use is compared to a limit. When below the limit, control passes to step 110. When above the limit, at step 128, processor 38 provides a signal to controls and displays 42 to indicate a warning message and effect a condition avoiding or limiting wasteful low-quality printing. At step 130, a report is communicated over network 14 signaling further use of printer 16 should be avoided. In a preferred embodiment, system operator terminal 18 responds to the report by directing further print data to other network resources and advising the system operator in regard to proper management of the supply. For example, appropriate inventory control action may be needed, as described in general in U.S. Pat. No. 5,305,199 to LoBiondo et al. for automatic inventory tracking and ordering of toner.

In alternate methods, total estimated use is signaled for further operation within the supply. In one embodiment the signal is used for storing total estimated use on a replaceable supply cartridge. Circuitry in the cartridge, on receipt of the signal, indicates total estimated use on the cartridge for system operator reference. In another embodiment the signal is used for regulating or terminating further dispensing of the supply as in U.S. Pat. No. 5,491,540 to Hirst.

The foregoing description discusses preferred embodiments of the present invention, which may be changed or modified without departing from the scope of the present invention.

For example, in alternate embodiments of system 10, shown in FIG. 1, monochromatic printer 16 is replaced with a copier, a facsimile machine, a graphic hardcopy device for film, slides, video, or transparencies, a terminal with built-in print apparatus; or similar devices capable of multi-color reproduction.

The electrostatographic apparatus of printer 16, in alternate embodiments, is replaced with ink jet printing apparatus. The quantity of ink flow through a nozzle in such an embodiment to produce quality printing is dependent on relative humidity and the hygroscopic quality of the page media. Estimates of the consumption of ink as a printing consumable are calculated according to appropriate empirical studies and the methods discussed with reference to FIG. 6.

In yet another embodiment, wherein printer 16 is replaced with color printing apparatus of either the electrostatographic or ink jet type, availability and application of various consumable chemicals, inks, pigments, and oils affects the quality of color saturation on various media. Color density is also indicated by test patterns of the type described in patent application Docket No. 10960276-1, "Self-Indicating Test Page for Use in Setting Density Level And Color Balance in a Color Laser Printer", by Trask et al. Estimates of the consumption of each of such various supplies as a printing consumable are calculated according to appropriate empirical studies and the methods discussed with reference to FIG. 6.

Relative humidity sensor 46, in alternate embodiments is replaced with apparatus for measuring other ambient conditions, for example, dielectric break down voltage of the ambient air, ion or particulate count, and cooling rate. Relative humidity is subsumed in a measurement of dielectric break down voltage as is the count of air borne ions and particulates. Not wire techniques, known for determining relative humidity as a result of measuring cooling rate, are used in an alternate embodiment.

Still further, those skilled in the art will understand that the circuit functions of input circuit 32, memory 34, output circuit 36, bus 40, controls and displays 42, supply 48, print engine 44, and sensor 46 are subject to conventional systems engineering design choice as to packaging and integrated circuit development for economical manufacturing and field service. For example, in a preferred embodiment, processor 38 is divided with a portion of the processing capability resident within the print engine and implemented with ASIC devices for hardware accumulation of subpixel counts. The remaining processing tasks are implemented in a second processor with conventional microprocessor circuitry and firmware. In such an embodiment, both processors and the sensor cooperate as a means for determining a low toner condition.

In an alternate embodiment, relative humidity sensor 46 provides a signal read for toner consumption estimates as already described and also used for control of other electrostatographic processes including adjustment of corona current in a transfer station of the type described in U.S. Pat. No. 5,436,705 to Raj. By adjusting the corona current, whether by amplitude or pulse width, the rate of consumption of toner is adjusted and the applicability of the empirically derived toner use adjustment factor is maintained for improved accuracy of toner consumption estimates.

These and other changes and modifications are intended to be included within the scope of the present invention.

While for the sake of clarity and ease of description, several specific embodiments of the invention have been described; the scope of the invention is intended to be measured by the claims as set forth below. The description is not intended to be exhaustive or to limit the invention to the form disclosed. Other embodiments of the invention will be apparent in light of the disclosure to one of ordinary skill in the art to which the invention applies.

All U.S. Patents and Patent Applications cited in this specification are incorporated herein by this reference where appropriate for teaching of technical background, problems, and additional or alternative details.

The words and phrases used in the claims are intended to be broadly construed. A "system" refers generally to electrical apparatus and includes but is not limited to one or more of the following components in cooperation: a computer, a workstation, a copier, a facsimile machine, and a memory. A "printer" refers generally to printing apparatus including but not limited to a personal computer printer, a copier, and a facsimile machine. A "memory" refers generally to digital data storage apparatus and includes but is not limited to an integrated circuit, a disk system, a tape system, a CDROM system, combinations thereof and equivalents. A "processor" refers generally to digital logic circuitry and includes but is not limited to a microprocessor, a microcontroller, a sequential machine, an application specific integrated circuit (ASIC), a charge-coupled device, combinations thereof and equivalents:

A "signal" refers to mechanical and/or electromagnetic energy conveying information. When elements are coupled, a signal is conveyed in any manner feasible with regard to the nature of the coupling. For example, if several electrical conductors couple two elements, then the relevant signal comprises the energy on one, some, or all conductors at a given time or time period. When a physical property of a signal has a quantitative measure and the property is used by design to control or communicate information, then the signal is said to be characterized by having a "value," The amplitude may be instantaneous or an average.

What is claimed is:

1. A system that estimates consumption of a printing supply, the system comprising:

a. an ambient condition sensor;

b. memory that stores a pixel description; and c. a processor that provides a signal in response to estimating incremental consumption of the printing supply, wherein estimating is responsive to the sensor and to the pixel description.

2. The system of claim 1, wherein the sensor is responsive to a dielectric breakdown voltage of ambient air.

3. The system of claim 1, wherein the sensor is responsive to relative humidity of ambient air.

4. The system of claim 1, wherein:

a. the pixel description comprises a plurality of subpixel descriptions; and b. the processor estimates incremental consumption of the supply in further response to a subpixel description of the plurality of subpixel descriptions.

5. The system of claim 4, wherein the processor:

a. determines a classification for the subpixel description in response to a neighboring subpixel description of the plurality of subpixel descriptions; and b. estimates incremental consumption of the supply in further response to the classification.

6. The system of claim 5, wherein the processor accumulates for each classification a count of subpixels.

7. The system of claim 6, wherein the processor calculates an incremental estimate in response to a weighted sum of accumulated classification counts.

8. The system of claim 1, further comprising a monitor that advises managing of the supply, the monitor being responsive to the signal.

9. The system of claim 8 further comprising a network for coupling the monitor to the processor.

10. The system of claim 1, wherein:

a. the memory further stores a plurality of supply consumption factors, each factor corresponding respectively to a sensor signal value of a plurality of sensor signal values; and b. the processor estimates incremental consumption of the supply in further response to a factor of the plurality of factors.

11. The system of claim 1, wherein a rate of consumption of the supply is adjusted in response to the signal.

12. The system of claim 1, wherein the supply comprises toner.

13. The system of claim 1, wherein the supply comprises ink.

14. A printer comprising:

a. first means for determining data that describes a plurality of pixels to be printed;

b. a humidity sensor that provides a sensor signal; and c. second means for determining a low toner condition, the second means comprising a circuit that estimates toner consumption in response to the data and to the sensor signal.

15. The printer of claim 14, further comprising third means for providing a report at a location remote from the printer, the report responsive to the estimated toner consumption.

16. A method for sensing consumption of a printing supply, the method comprising:

a. receiving a first signal proportional to an ambient condition;

b. receiving a second signal that describes a plurality of pixels to be printed; and c. providing a third signal in response to an estimate of consumption of the printing supply, wherein the estimate is responsive to the first signal and the second signal.

17. The method of claim 16, further comprising:

a. accumulating the estimate over a time; and b. providing the third signal in response to comparing the accumulated estimate to a limit.

18. The method of claim 16, further comprising:

a. analyzing the second signal to determine a position of a pixel of the plurality of pixels;

b. associating a classification to the pixel in response to its position in a region;

c. accumulating a count of pixels of the plurality having the classification; and d. estimating consumption of the supply in further response to the count.

19. The method of claim 16, further comprising:

a. analyzing the second signal to determine a representation of a pixel of the plurality of pixels, the representation comprising a plurality of subpixels;

b. determining a weight for a subpixel; accumulating a count of subpixels having the same weight; and c. estimating consumption of the supply in further response to the weight.

20. The method of claim 16, further comprising controlling dispensing of the supply in response to the third signal.

* * * * *